US006393866B1

(12) United States Patent
Srinivasan et al.

(10) Patent No.: US 6,393,866 B1
(45) Date of Patent: May 28, 2002

(54) CRYOGENIC CONDENSATION AND VAPORIZATION SYSTEM

(75) Inventors: Vijayaraghavan Srinivasan, Williamsville; Michael James Lockett, Grand Island, both of NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 09/861,565

(22) Filed: May 22, 2001

(51) Int. Cl.[7] ..... F25J 3/00
(52) U.S. Cl. ..... 62/643; 62/903; 165/166
(58) Field of Search ..... 62/643, 903; 165/166

(56) References Cited

U.S. PATENT DOCUMENTS

| | | | | | |
|---|---|---|---|---|---|
| 1,963,840 | A | * | 6/1934 | Frankl | 62/903 |
| 3,992,168 | A | * | 11/1976 | Toyama et al. | 62/903 |
| 4,436,146 | A | | 3/1984 | Smolarek | 165/111 |
| 4,498,303 | A | * | 2/1985 | Heichberger | 62/903 |
| RE33,026 | E | | 8/1989 | Petit et al. | 62/36 |
| 5,071,458 | A | | 12/1991 | Grenier et al. | 62/42 |
| 5,122,174 | A | | 6/1992 | Sunder et al. | 62/24 |
| 5,321,954 | A | | 6/1994 | Lehman et al. | 62/36 |
| 5,438,836 | A | | 8/1995 | Srinivasan et al. | 62/36 |
| 5,537,840 | A | | 7/1996 | Srinivasan et al. | 62/643 |
| 5,699,671 | A | | 12/1997 | Lockett et al. | 62/63 |
| 5,718,127 | A | * | 2/1998 | Aitken | 62/643 |
| 5,724,834 | A | | 3/1998 | Srinivasan et al. | 62/643 |
| 5,901,574 | A | * | 5/1999 | Rohde | 62/640 |
| 6,189,338 | B1 | * | 2/2001 | Lehman | 62/643 |
| 6,338,384 | B1 | * | 1/2002 | Sakaue et al. | 165/166 |

* cited by examiner

*Primary Examiner*—Ronald Capossela
(74) *Attorney, Agent, or Firm*—Stanley Ktorides

(57) ABSTRACT

A system, especially useful under cryogenic conditions, for downflowing cocurrent condensation of vapor against downflowing partially vaporizing liquid, wherein the condensing vapor flows within tubes having fluted internal surfaces and the boiling liquid flows along the outer surfaces of the tubes having re-entrant cavities.

10 Claims, 2 Drawing Sheets

CRYOGENIC CONDENSATION AND VAPORIZATION SYSTEM

TECHNICAL FIELD

This invention relates generally to the condensation of vapor and the vaporization of liquid by indirect heat exchange and is particularly applicable for use with a cryogenic air separation system.

BACKGROUND ART

An important aspect of a cryogenic air separation system employing a double column is the condensation of the higher pressure column top vapor against boiling lower pressure column bottom liquid to provide reflux for the columns and boilup for the lower pressure column. This heat exchange is generally carried out in a shell and tube heat exchanger or a brazed aluminum heat exchanger. Since the bottom liquid comprises oxygen, it typically is processed within the tubes of the heat exchanger while the higher pressure column top vapor is processed on the shell side of the heat exchanger.

The heat exchangers for this purpose are of two main types. In the thermosyphon configuration the oxygen liquid enters the tubes at the bottom and is vaporized as it passes up the tubes. In the downflow configuration the oxygen liquid is vaporized as it flows downwardly within the tubes. While both of these configurations ensure safe operation of the heat exchanger, which is an important consideration when liquid oxygen is being vaporized, both of these configurations have disadvantages. The thermosyphon configuration suffers from the disadvantage of requiring a larger temperature difference between the hotter and the colder fluids due to the hydrostatic head at the inlet to the boiling section. The downflow configuration requires special flow distributors for effective liquid distribution to the tube inlets, significantly increasing the cost and complexity of the system.

Accordingly, it is an object of this invention to provide an improved condensation and vaporization system which can be effectively employed to vaporize liquid oxygen such as in carrying out cryogenic air separation.

SUMMARY OF THE INVENTION

The above and other objects, which will become apparent to those skilled in the art upon a reading of this disclosure, are attained by the present invention, one aspect of which is:

A method for carrying out cryogenic air separation comprising:

(A) separating feed air within a higher pressure column by cryogenic rectification to produce nitrogen-enriched vapor and oxygen-enriched fluid, passing oxygen-enriched fluid from the higher pressure column into a lower pressure column, and producing by cryogenic rectification oxygen-rich liquid within the lower pressure column;

(B) passing nitrogen-enriched vapor into a plurality of vertically oriented tubes, said tubes each having a fluted internal surface and an outer surface having a plurality of cavities;

(C) passing nitrogen-enriched vapor downwardly within the tubes, passing oxygen-rich liquid downwardly along the outer surfaces of the tubes, and condensing nitrogen-enriched vapor by indirect heat exchange with partially vaporizing oxygen-rich liquid to produce oxygen-rich vapor and remaining oxygen-rich liquid; and (D) recovering at least some of at least one of the oxygen-rich vapor and remaining oxygen-rich liquid as product oxygen.

Another aspect of the invention is:

A method for boiling and condensing fluids comprising:

(A) providing a condenser/boiler having a plurality of vertically oriented tubes, each of said tubes having a top entrance and bottom exit and having a fluted internal surface and an outer surface having a plurality of cavities;

(B) passing vapor into the entrances of the tubes and downwardly within the tubes, condensing the vapor within the tubes, and withdrawing the resulting condensate from the bottom exits of the tubes;

(C) passing liquid downwardly along the outer surfaces of the tubes and partially vaporizing the downflowing liquid to produce vaporized liquid and remaining liquid; and (D) collecting remaining liquid and recirculating remaining liquid to the outer surfaces of the tubes for downflow thereon.

Yet another aspect of this invention is:

Apparatus for boiling and condensing fluids comprising:

(A) a plurality of longitudinally oriented tubes, each of said tubes having an entrance and an exit and having a fluted internal surface and an outer surface having a plurality of cavities;

(B) means for passing vapor into the entrances of the tubes and means for withdrawing liquid from the exits of the tubes;

(C) means for providing liquid to the outer surfaces of the tubes for downflow thereon; and (D) means for collecting liquid from the outer surfaces of the tubes and recirculating said collected liquid to the outer surfaces of the tubes.

As used herein, the term "feed air" means a mixture comprising primarily oxygen and nitrogen, such as ambient air.

As used herein, the term "fluted surface" means a surface having longitudinally running raised ribs. An example of a fluted surface is illustrated in FIG. 4.

As used herein the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process.*

The term-"double column" is used to mean a higher pressure column having its upper portion in heat exchange relation with the lower portion of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Distillation is the separation process whereby heating of a liquid mixture can be used to concentrate the more volatile component(s) in the vapor phase and thereby the less volatile component(s) in the liquid phase. Partial condensation is the separation process whereby cooling of a vapor mixture can be used to concentrate the volatile component(s) in the vapor phase and thereby the less volatile component (s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases can be adiabatic or nonadiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein the term "indirect heat exchange" means the bringing of two fluids into heat exchange relation without any physical contact or intermixing of the fluids with each other.

Figure 1:
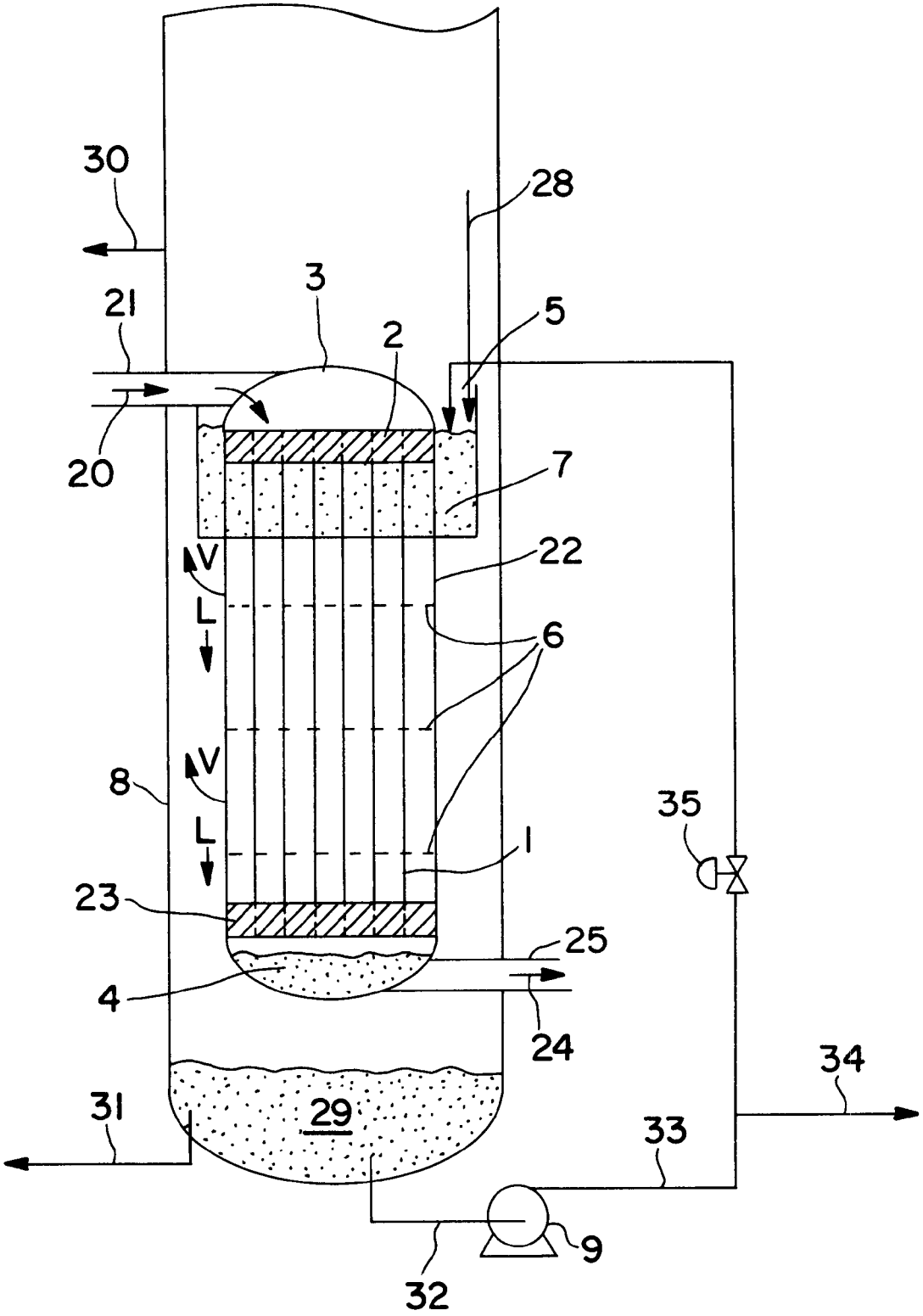
FIG. 1 is a cross-sectional representation of one preferred embodiment of system of this invention operating within the lower pressure column of a double column cryogenic air separation system.

The numerals in the Drawings are the same for the common elements.

DETAILED DESCRIPTION

The invention will find particularly effective use as the main condenser/reboiler function of a double column cryogenic air separation plant, and it is with this use that the invention will be described in detail.

Feed air is provided into the higher pressure column (not shown in the Drawings) of a double column cryogenic air separation plant wherein it is separated by cryogenic rectification into nitrogen-enriched vapor, generally having a nitrogen concentration of at least 99.9 mole percent, and into oxygen-enriched liquid, generally having an oxygen concentration within the range of from 30 to 40 mole percent. Oxygen-enriched fluid, as liquid and/or vapor, is passed from the higher pressure column into a lower pressure column, which is operating at a pressure less than that of the higher pressure column. The fluids passed into the lower pressure column are separated by cryogenic rectification to produce nitrogen-rich vapor and oxygen-rich liquid.

Referring now to FIG. 1, nitrogen-enriched vapor 20 from the higher pressure column is passed through inlet conduit 21 into inlet chamber 3 of condenser/boiler 22 which is positioned in the lower portion of lower pressure column 8 below the separation internals such as trays or packing. Condenser/boiler 22 comprises a plurality of longitudinally oriented tubes 1 which are attached, usually by welding, to top tubesheet 2 and bottom tubesheet 23, and are further supported by baffles 6. When in operating position the longitudinally oriented tubes are vertically oriented as shown in FIG. 1. The tubes may have any effective cross-sectional configuration, although generally and preferably the tubes will have a circular cross-sectional shape.

Figure 4:
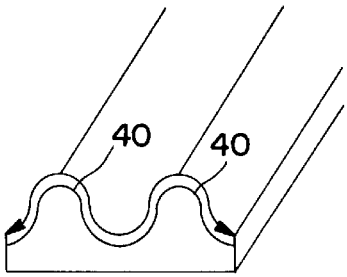
FIG. 4 is a perspective view illustrating one example of flutes which may be employed on the internal surfaces of the tubes used in the practice of this invention.

Each tube has an internal surface and an outer surface. The internal surface of each tube is fluted, i.e. it has a plurality of flutes running along the length, preferably the entire length, of the tube to enhance the condensation heat transfer. One example of the flutes and the fluted internal surface of the tubes is illustrated in FIG. 4 showing flutes 40. The nitrogen-enriched vapor flows from inlet chamber 3 into the entrances of the tubes which are preferably in the same plane, which when the tubes, are vertically oriented, is the same horizontal plane or level. The nitrogen-enriched vapor flows downwardly within the tubes and is condensed, preferably completely condensed, by the time it traverses the length of the tubes. The resulting condensate, i.e. nitrogen-enriched liquid, is withdrawn from the bottom exits of the tubes into outlet chamber 4. As was the case with the top entrances of the tubes, preferably the exits of the tubes are in the same plane. The nitrogen-enriched liquid 24 is passed out of condenser/boiler 22 in conduit 25 and is passed into the upper portion of the higher pressure column and also into the upper portion of the lower pressure column 8 as reflux liquid for carrying out the cryogenic rectification. If desired, a portion of the nitrogen-enriched liquid may be recovered as product nitrogen.

Figure 2:
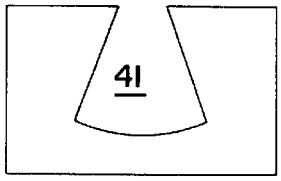
FIGS. 2 and 3 illustrate two examples of cavities which may be used as part of the enhanced boiling outer surface of the tubes used in the practice of this invention.
Figure 3:
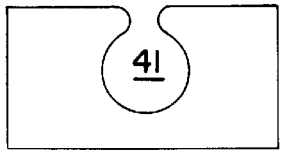
Figure 5:
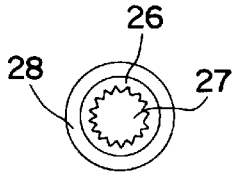
FIG. 5 is a lateral cross section view of one embodiment of a tube useful in the practice of the invention showing the fluted internal surface and the enhanced boiling outer surface.

The outer surface of each tube has an enhanced boiling surface characterized by a plurality of cavities or depressions. Two examples of such cavities 41 are shown in cross-section in FIGS. 2 and 3. The enhanced boiling surface with the re-entrant cavities operates by trapping vapor within the cavities for initiating boiling at low tube wall superheats, which is defined as the temperature difference between the tube wall surface and the saturation temperature of the fluid to be vaporized. A cross-sectional representation of one embodiment of a tube useful in the practice of this invention is illustrated in FIG. 5 showing tube wall 26, fluted internal surface 27 and enhanced boiling outer surface 28.

Referring back now to FIG. 1, oxygen-rich liquid 28, generally having an oxygen concentration of at least 99 mole percent, is passed from the separation stages of column 8 into flow distributor 7 through inlet nozzle 5. Flow distributor 7 is employed to ensure that the oxygen-rich liquid is distributed uniformly among the different tubes and around the periphery of each tube. The oxygen-rich liquid flows downwardly along the outer surfaces of the tubes in cocurrent indirect heat exchange with the previously described downflowing condensing nitrogen-enriched vapor. As the oxygen-rich liquid flows down along the enhanced boiling outer surfaces of the tubes, a portion of the downflowing oxygen-rich liquid is boiled off or vaporized, as shown by arrows V in FIG. 1, while the remaining liquid, shown by arrows L in FIG. 1, is collected in the sump of column 8 as shown by liquid pool 29.

The oxygen-rich vapor boiled off the outer surfaces of the tubes passes up through column 8 as vapor upflow for the cryogenic rectification. If desired a portion of the oxygen-rich vapor may be recovered as product gaseous oxygen as shown by line 30. If desired a portion of the remaining oxygen-rich liquid 29 may be recovered as product liquid oxygen as shown by line 31. The embodiment of the invention illustrated in FIG. 1 is a preferred embodiment wherein some remaining oxygen-rich liquid 29 is recirculated to the tubes in order to ensure that the outer surfaces of the tubes remain wet, thereby avoiding a boiling to dryness condition which is inefficient and, when the liquid comprises liquid oxygen, is also dangerous. For the recirculation flow, oxygen-rich liquid 29 is withdrawn from column 8 in line 32 and pumped by liquid recirculation pump 9 to a higher pressure to form pressurized stream 33. If desired, a portion 34 of stream 33 may be recovered as higher pressure liquid oxygen product. Stream 33 is then passed through valve 35 and into flow distributor 7 for processing as was previously described. If desired, one or more intermediate flow distributors may be used below the position of flow distributor 7 for receiving some of the recirculated oxygen-rich liquid for distribution to and downflow on the tubes.

Typically in the practice of this invention the tubes will have internal diameters within the range of from 16 to 25 millimeters. Although a shell may be used around the tube bundle in the practice of this invention, as is conventional for shell and tube heat exchangers, an important advantage of this invention is the elimination of the need for a shell for the tube bundle. That is, the bare tube bundle may be positioned within the column where the oxygen-rich liquid is boiled off on the external surfaces of the tubes and the vapor directly escapes to rise up the column. This also eliminates the need for expansion bellows which are expensive and are required to accommodate the differential expansion between the shell and the tube bundle. If desired, nitrogen-rich vapor may be recovered from the upper portion of the lower pressure column as product gaseous nitrogen.

Figure 6:
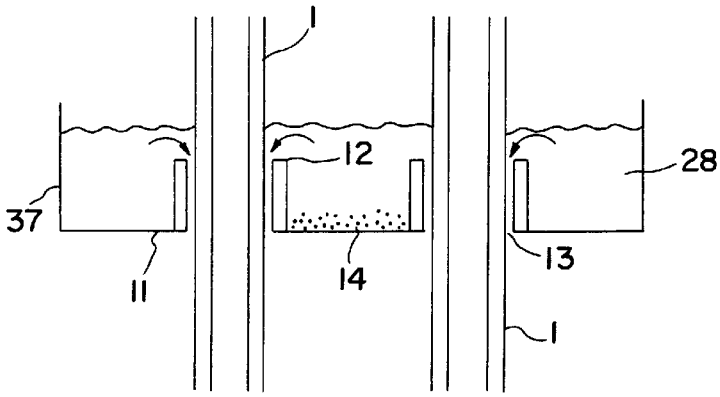
FIG. 6 is a cross-sectional view of a preferred embodiment of a liquid distributor which may be employed in the practice of this invention.

FIG. 6 illustrates in greater detail one preferred embodiment of the flow distributor for use in the practice of this invention. Referring now to FIG. 6, the preferred flow distributor 37 has trough 11 for containing oxygen-rich liquid 28 around tubes 1. The distributor holes are provided with upward projecting lips 12 that form as short sleeves around the tubes. A conventional flow distributor does not have such lips but rather has a simple clearance between the flow distributor trough and the outer surface of the tube. In this preferred embodiment, the oxygen-rich liquid flows through the clearances 13 between the lips 12 and tubes 1. The main advantage of the design illustrated in FIG. 6 is that it enables dirt or solid impurities 14 to collect on the distribution baffle without blocking the clearances 13.

Although the invention has been described in detail with reference to certain preferred embodiments, those skilled in the art will recognize that there are other embodiments of the invention within the spirit and the scope of the claims. For example, the invention may be used for any application involving boiling on the outside and condensing on the inside of the tubes. It may be used with other cryogenic fluids such as argon or with other fluids in general such as hydrocarbons.

What is claimed is:

1. A method for carrying out cryogenic air separation comprising:

(A) separating feed air within a higher pressure column by cryogenic rectification to produce nitrogen-enriched vapor and oxygen-enriched fluid, passing oxygen-enriched fluid from the higher pressure column into a lower pressure column, and producing by cryogenic rectification oxygen-rich liquid within the lower pressure column;

(B) passing nitrogen-enriched vapor into a plurality of vertically oriented tubes, said tubes each having a fluted internal surface and an outer surface having a plurality of cavities;

(C) passing nitrogen-enriched vapor downwardly within the tubes, passing oxygen-rich liquid downwardly along the outer surfaces of the tubes, and condensing nitrogen-enriched vapor by indirect heat exchange with partially vaporizing oxygen-rich liquid to produce oxygen-rich vapor and remaining oxygen-rich liquid; and (D) recovering at least some of at least one of the oxygen-rich vapor and remaining oxygen-rich liquid as product oxygen.

2. The method of claim 1 wherein at least some of the remaining oxygen-rich liquid is recirculated for additional downward flow along the outer surfaces of the tubes.

3. A method for boiling and condensing fluids comprising:

(A) providing a condenser/boiler having a plurality of vertically oriented tubes, each of said tubes having a top entrance and bottom exit and having a fluted internal surface and an outer surface having a plurality of cavities;

(B) passing vapor into the entrances of the tubes and downwardly within the tubes, condensing the vapor within the tubes, and withdrawing the resulting condensate from the bottom exits of the tubes;

(C) passing liquid downwardly along the outer surfaces of the tubes and partially vaporizing the downflowing liquid to produce vaporized liquid and remaining liquid; and (D) collecting remaining liquid and recirculating remaining liquid to the outer surfaces of the tubes for downflow thereon.

4. The method of claim 3 wherein at least one of the vapor passed into the tubes and the liquid passed along the outer surfaces of the tubes comprises nitrogen.

5. The method of claim 3 wherein at least one of the vapor passed into the tubes and the liquid passed along the outer surfaces of the tubes comprises oxygen.

6. Apparatus for boiling and condensing fluids comprising:

(A) a plurality of longitudinally oriented tubes, each of said tubes having an entrance and an exit and having a fluted internal surface and an outer surface having a plurality of cavities;

(B) means for passing vapor into the entrances of the tubes and means for withdrawing liquid from the exits of the tubes;

(C) means for providing liquid to the outer surfaces of the tubes for downflow thereon; and (D) means for collecting liquid from the outer surfaces of the tubes and recirculating said collected liquid to the outer surfaces of the tubes.

7. The apparatus of claim 6 wherein the means for providing liquid to the outer surfaces of the tubes comprises at least one flow distributor having a trough through which the tubes pass and having a clearance between the trough and the outer surface of each tube.

8. The apparatus of claim 7 further comprising lips running from the flow distributor through adjacent the respective tubes.

9. The apparatus of claim 6 wherein the means for recirculating collected liquid to the outer surfaces of the tubes comprises a liquid pump.

10. The apparatus of claim 6 wherein the entrances of the tubes are in the same plane.

* * * * *

UNITED STATES PATENT AND TRADEMARK OFFICE

CERTIFICATE OF CORRECTION

PATENT NO. : 6,393,866 B1
DATED : May 28, 2002
INVENTOR(S) : Srinivasan et al.

It is certified that error appears in the above-identified patent and that said Letters Patent is hereby corrected as shown below:

Column 6,
Line 59, delete "through" and insert therefor -- trough --.

Signed and Sealed this

Twenty-fourth Day of September, 2002

*Attest:*

*Attesting Officer*

JAMES E. ROGAN
*Director of the United States Patent and Trademark Office*